US008468744B2

(12) United States Patent
Fullick

(10) Patent No.: US 8,468,744 B2
(45) Date of Patent: Jun. 25, 2013

(54) LATCH MECHANISM WITH EXTENDED SIDE WALL

(76) Inventor: Ken Fullick, McHenry, IL (US)

( * ) Notice: Subject to any disclaimer, the term of this patent is extended or adjusted under 35 U.S.C. 154(b) by 2557 days.

(21) Appl. No.: 10/637,359

(22) Filed: Aug. 7, 2003

(65) Prior Publication Data

US 2005/0028446 A1 Feb. 10, 2005

(51) Int. Cl.
*E05D 15/22* (2006.01)

(52) U.S. Cl.
USPC ..... 49/185

(58) Field of Classification Search
USPC ..... 49/183–186, 449, 406, 458; 292/DIG. 20, 292/DIG. 33, DIG. 35, DIG. 47, DIG. 73
See application file for complete search history.

(56) References Cited

U.S. PATENT DOCUMENTS 2,379,528 A * 7/1945 Kelliher ..... 49/182
5,139,291 A * 8/1992 Schultz ..... 292/42
5,274,955 A * 1/1994 Dallaire et al. ..... 49/406
6,026,617 A * 2/2000 Stark ..... 52/204.66

* cited by examiner

*Primary Examiner* — Jerry Redman
(74) *Attorney, Agent, or Firm* — Lawrence J. Chapa

(57) ABSTRACT

A latch mechanism adapted for being coupled to a window sash, which travels within a window frame, is disclosed which includes a main housing having a sidewall including one or more sidewall sections. The sidewall including one or more sidewall sections extends around at least a portion of the housing and defines an interior space and includes an opening in said sidewall at one end of said housing. The sidewall further defines a channel within the interior space of the main housing, which has an end that coincides with said opening. At least one of the sidewall sections which is substantially parallel to the direction of travel of the bolt is adapted to extend down from the top of the top rail of the window sash along at least a portion of the external surface of a corresponding one of the front facing and the back facing of the top rail. The latch mechanism further includes a bolt, which is substantially located within said housing and travels along said channel. The bolt has a first end which is adapted for extending through the opening of said housing and extending into the side jamb of the window frame. The latch mechanism still further includes a tension device coupled to the bolt and the main housing for biasing the bolt toward a position where the bolt extends at least partially through the opening.

17 Claims, 4 Drawing Sheets

LATCH MECHANISM WITH EXTENDED SIDE WALL

FIELD OF THE INVENTION

The invention pertains to a latch mechanism adapted for use in a sash window assembly. More specifically, the invention pertains to a latch mechanism having at least one sidewall which extends down from the top of the top rail of the window sash along a portion of the external surface of a corresponding one of the front facing and the back facing of the top rail.

BACKGROUND OF THE INVENTION

Tiltable window assemblies have previously incorporated tilt latches at the end of the window sash opposite the pivot bar of the tilt mechanism. The previous latch mechanisms have generally provided additional mechanical support for maintaining the window sash in a non-tilted position, so as to be oriented in a plane which enables a direction of travel of the window sash within the window frame.

Prior tilt latches have included a bolt, which travels within a latch housing, and which selectively engages the side jamb of the window frame. The bolts generally have an angled surface at the end of the bolt and on the side of the bolt, that engages the side jamb. When the angled surface of the bolt engages the side jamb as the window sash moves from a tilted position to a non-tilted position, the angled surface of the bolt causes the bolt to at least momentarily deflect inward until it clears the obstructing portion of the side jamb.

The other side of the end of the bolt that engages the side jamb as the window sash moves from a non-tilted position to a tilted position, is generally perpendicular to the direction of tilting movement. The generally perpendicular side of the bolt, when it engages the obstructing portion of the side jamb does not deflect the bolt, but engages the side jamb and resists movement toward a tilted position. Generally the sash is rotationally locked in a non-tilted position within the window frame until the end of the bolt of the tilt latch, which is generally biased toward engagement, is manually retracted and released from the side jamb. An early example of such a tilt latch is described in Menns, U.S. Pat. No. 1,862,757.

Window can be subjected to extreme weather conditions, where the required response to the extreme weather conditions are often dictated by building codes. Trends in building codes have increasingly required that the window assemblies be able to survive increasingly extreme weather conditions. One such example includes high winds or large pressure differentials between indoor and outdoor pressures, which can be associated with tornadoes and/or hurricanes. Windows may also be expected to survive an impact from one or more types of flying debris. Examples of different types of materials used to simulate flying debris includes two-by-four pieces of wood and ball bearings to simulate small rocks and/or hail.

Historically, accepted wisdom suggested that one should open the window slightly during a tornado or a hurricane, so as to provide an air path via which the air pressure on the interior side of the window can more easily be equated to the air pressure on the external side of the window. However, more recently, the generally accepted wisdom has changed to suggest, that one should maintain the window in a closed position. This is because storms, which have high winds, like hurricanes, are often accompanied by rain. By opening the window during such a storm, one may be subjecting the interior of the building to potential water damage, where any pressure equalizing effects are now viewed as having only a marginal effect. Additionally, opening the window slightly may affect the structural integrity of the window by disengaging elements, which would otherwise overlap and/or be locked together.

As the building code requirements become increasingly stringent, the building techniques and the components used in the construction of a window assembly need to keep pace or stay ahead of the stricter standards, in order to be able to sell into the markets covered by the building codes. Consequently, there is a need to develop building techniques and/or better components and incorporate them into the window assemblies, in order to enhance the integrity of the window, and allow it to withstand greater and greater harmful forces, as required by the building codes.

Many currently used window assemblies include plastic extruded jamb liners, which can deflect when under relatively high levels of stress. Similarly, the top and bottom rails, as well as the stiles of the window sash for many window assemblies are also made from extruded plastic components, which are then welded together at the joints. The plastic extruded top and bottom rails can similarly bow and/or deflect, when significant external forces are applied.

As the window sash bows and/or deflects, the ends of the top and bottom rails can be deflected away from the side jamb toward the center of the window assembly. This in turn can pull the attached tilt latch assemblies away from and out of engagement with the side jamb. As a result, the tilt latch assemblies may no longer prevent the tilt motion of the window sash. Additionally the tilt latch assemblies may no longer anchor the non-pivot point side of the window sash within the window frame. This then becomes a weak point in the window construction, and a likely point for failure, when extreme forces are applied.

Still further, the flexing of the window assemblies, as a result of and in addition to the high wind forces, can sometimes cause the mounted window hardware to shear away, thereby further affecting the continued integrity of the window assembly. Consequently, it would be beneficial to develop a tilt-latch, which resists becoming detached or torn away from the window sash, and which adds additional support to the window assembly when the window assembly is subjected to higher levels of stress.

SUMMARY OF THE INVENTION

A latch mechanism adapted for being coupled to a window sash, which travels within a window frame, is provided which includes a main housing having a sidewall including one or more sidewall sections. The sidewall including one or more sidewall sections extends around at least a portion of the housing and defines an interior space and includes an opening in said sidewall at one end of said housing. The sidewall further defines a channel within the interior space of the main housing, which has an end that coincides with said opening. At least one of the sidewall sections which is substantially parallel to the direction of travel of the bolt is adapted to extend down from the top of the top rail of the window sash along at least a portion of the external surface of a corresponding one of the front facing and the back facing of the top rail.

The latch mechanism further includes a bolt, which is substantially located within said housing and travels along said channel. The bolt has a first end which is adapted for extending through the opening of said housing and extending into the side jamb of the window frame. The latch mechanism still further includes a tension device coupled to the bolt and the main housing for biasing the bolt toward a position where the bolt extends at least partially through the opening.

In at least one embodiment of the invention, at least a second one of the sidewall sections of the main housing, which is substantially parallel to the direction of travel of the bolt, extends down from the top of the top rail of the window sash along the external surface of at least a portion of the other one of the front facing and the back facing of the top rail.

In at least a further embodiment, the interlock element extends down further from the top of the top rail of the window sash along at least a portion of the external surface of one of the front facing and the back facing of the top rail a distance away from the one of the front facing and the back facing. The distance between the interlock element and the one of the front facing and the back facing provides for a space, therebetween, within which at least a part of the sash interlock associated with the bottom rail of the top sash will occupy, when the interlock element of the latch mechanism is engaged with the sash interlock.

In a still further embodiment, the interlock element extends from the at least one sidewall section initially in an upward direction before further extending in a downward direction a distance away from the one of the front facing and the back facing.

In yet a still further embodiment, one or more of the latch mechanisms are incorporated as part of a window assembly including a top sash and a bottom sash.

A further aspect of the present invention, a sash interlock is provided, which is adapted to be coupled to a bottom rail of a top sash of a window assembly including a top sash and a bottom sash. The sash interlock is further adapted to engage an interlock element of a latch mechanism coupled to the top rail of the bottom sash. The sash interlock includes a substantially vertically extending ridge, which is adapted to selectively engage the latch mechanism by entering the space formed between the interlock element of the latch mechanism and the corresponding one of the front facing and the back facing of the top rail of the bottom sash when the bottom sash moves within the window assembly towards a closed position.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
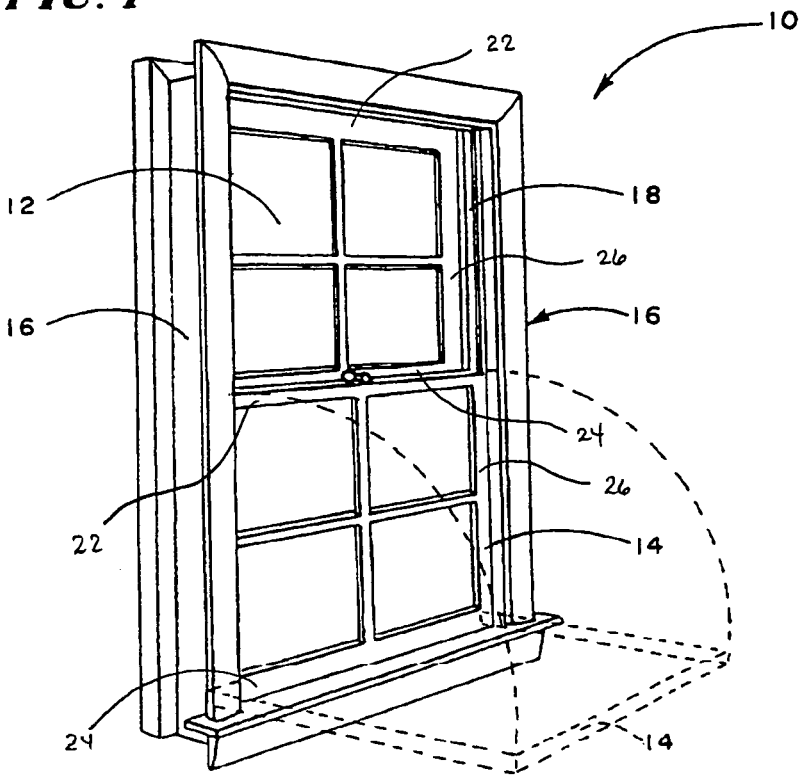
FIG. 1 is a perspective view of a tiltable sash window.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring now to the drawings in greater detail, there is illustrated in FIG. 1 a perspective view of a tiltable sash window assembly 10. The window assembly 10 has an upper outer (i.e. top) window sash 12 and a lower inner (i.e. bottom) window sash 14, which fit within two oppositely placed side jambs 16. Located within each of the two side jambs 16 is at least one jamb pocket 18. Coupled proximate to the top of each window sash 12, 14 are a pair of latch mechanisms 20 (FIG. 2), which are each located on opposite sides of the window sash 12, 14. The latch mechanisms 20 selectively engage the side jamb, and, while engaged, fix the top of the window sash 12, 14 relative to the side jamb 16. In at least some embodiments, a window sash balance shoe and a tensioning device or spring is located within each jamb pocket 18, which provides a counter balance force for the window sash 12, 14.

Figure 2:
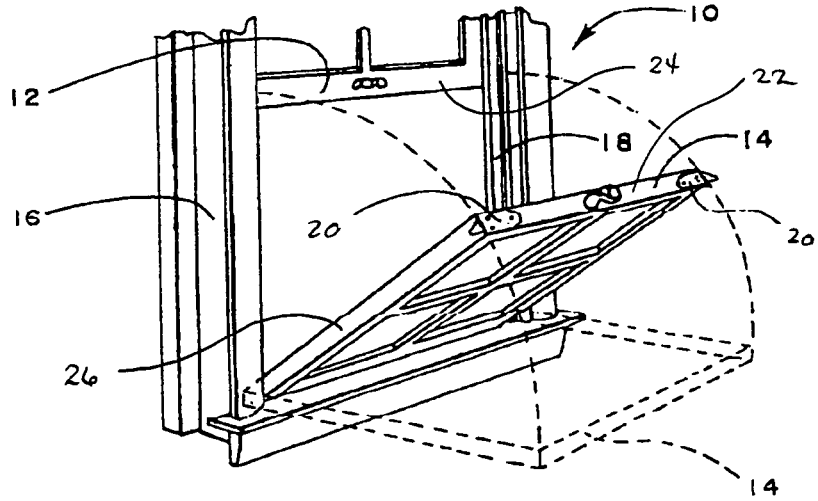
FIG. 2 is a perspective view of the tiltable sash window, illustrated in FIG. 1, with a portion broken away and showing the lower sash being tilted out of the window frame.

The window sashes 12, 14 are coupled to their corresponding window sash balance shoes via a pivot bar, which is attached to the bottom of the window sashes 12, 14. The pivot bar allows the window sash 12, 14 to pivot between a vertical and a horizontal position as shown in FIGS. 1 and 2, when the latch mechanism 20, and correspondingly the top of the window sash 12, 14, is released from the side jamb 16.

In the illustrated embodiment, each window sash includes a top rail 22, a bottom rail 24, and a pair of side stiles 26. In at least the illustrated embodiment, a pair of latch mechanisms are coupled to the top rail of at least the bottom sash.

Figure 3:
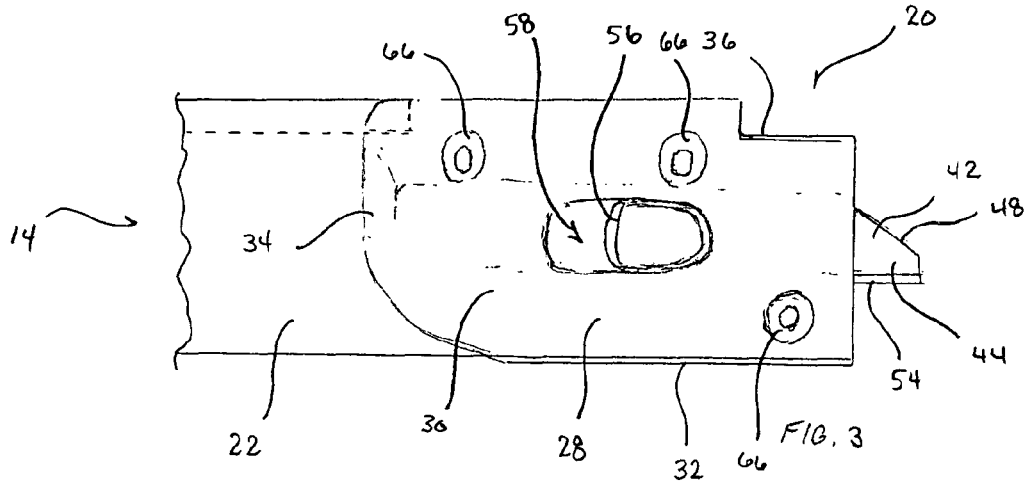
FIG. 3 is a top view of a tilt latch mechanism, in accordance with at least one embodiment of the present invention.

FIG. 3 illustrates a top view of a tilt latch mechanism 20, in accordance with at least one embodiment of the present invention. In at least the illustrated embodiment, the tilt latch mechanism 20 is coupled to the top of a top rail 22 of a window sash 14. The tilt latch mechanism 20 includes a main housing 28, which in the illustrated embodiment has a contoured top surface 30 that extends the width of the top rail 22 of the window sash 14. The main housing 28 further includes a sidewall having one or more sidewall sections 32, 34 and 36, which extend around at least a portion of the housing. The one or more sidewall sections 32, 34 and 36 form a channel 38 within the interior space of the tilt latch mechanism 20. The sidewall includes an opening 40, which coincides with at least one end of the channel 38.

Figure 8:
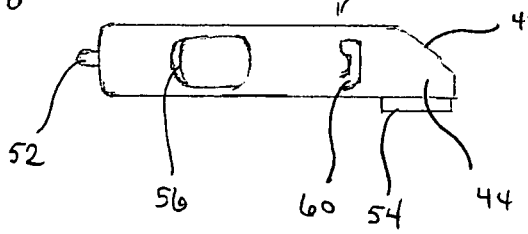
FIG. 8 is a top view of the bolt illustrated in FIG. 7.
Figure 9:
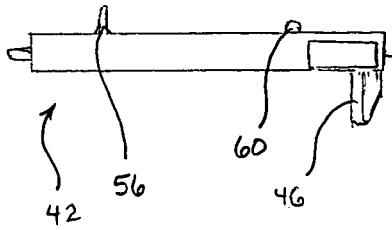
FIG. 9 is a side view of the bolt illustrated in FIGS. 7-8.

The tilt latch mechanism 20 further includes a bolt 42 (FIGS. 7-9), which is substantially located within the housing and travels along the channel 38. The bolt 42 has an end 44, which is adapted for extending through the opening 40 in the sidewall and extending into the side jamb 16 of the window frame. In the illustrated embodiment, the end 44 of the bolt 42 additionally includes a protrusion 46, which extends in the direction of travel of the window sash within the window frame. In at least some embodiments, the protrusion 46 extends in a downward direction, when the window sash is in an upright position. Further details relative to the protrusion 46 are included as part of U.S. application Ser. No. 10/325,622, entitled "A Latch Mechanism with Protrusion and Corresponding Pocket Brace", filed Dec. 18, 2002, the disclosure of which is hereby incorporated by reference.

The first end 44 of the bolt 42 has an angled surface 48 on the side of the bolt 42 which, when extended, contacts the side jamb 16, when the window sash 14 moves from a tilted position to a non-tilted position. In the embodiment illustrated in FIGS. 1 and 2, the non-tilted position corresponds to the vertical position, and the tilted position corresponds to the horizontal and any intermediate angled positions.

Figure 7:
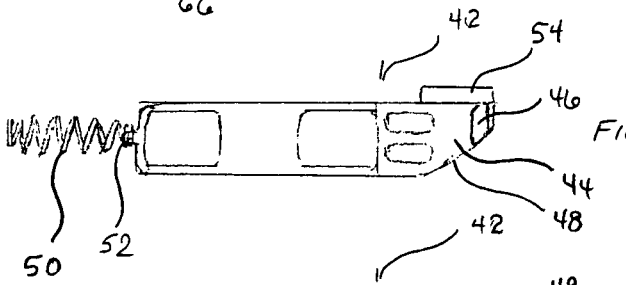
FIG. 7 is a bottom view of a bolt for use with the main housing, illustrated in FIG. 6.

The angled surface 48, when it contacts the side jamb 16 will bias the end 44 of the bolt 42 into the main housing 28, against a force exerted by a tension device 50 (FIG. 7) coupled between the bolt 42 and the portion 53 of the side wall section 34 corresponding to a closed end of the channel 38 of the main housing 24 and corresponding to the side of the channel 38 opposite the opening 40. In the illustrated embodiment, the tension device is coupled to a tail 52 located on the end of the bolt opposite the end 44 that extends through the opening 40. In at least one embodiment, the tension device 50 is a spring, as illustrated in FIG. 7. The other side 54 of the first end 44 of the bolt 42, or in other words the side 54 which contacts the side jamb 16, when the window sash 14 moves from a non-tilted position to a tilted position, is substantially perpendicular to the side jamb 16. Contact between the substantially perpendicular side 54 and the side jamb 16, generally does not meaningfully bias the bolt 42 within the channel 38 of the main housing 28. In this way the window sash 14 remains locked in a non-tilted position until the latch mechanism 20 is manually released.

Figure 6:
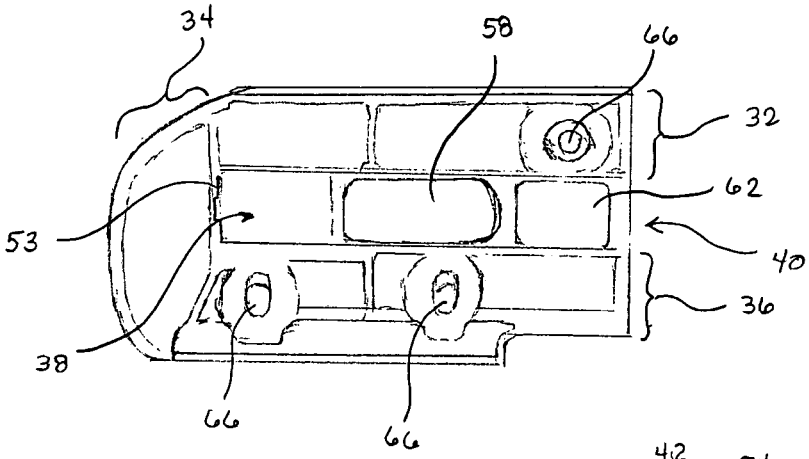
FIG. 6 is a bottom view of the main housing of the tilt latch mechanism, illustrated in FIGS. 3-5.

The manual release of the tilt latch mechanism 20 is facilitated by a finger contact 56 of the bolt 42, which extends through an opening 58 in the top surface 30 of the main housing 28. By engaging the finger contact 56, a user can bias the bolt 42 in a direction which is counter to the force applied by the tension device 50. The bolt further includes a tab 60 (FIGS. 8 and 9), which engages a pocket 62 (FIG. 6) formed in the underside of the top surface of the main housing 28. Together, the tab 60 and pocket 62, limit the permissible travel of the bolt within the channel 38, as well as provide support against the bolt 42 from being pulled out of the main housing 28 through the opening 40 in the sidewall.

In the illustrated embodiment, the latch mechanism 20 is coupled to the top rail 22 of the sash 14 via one or more fasteners 64 (FIG. 4), which extend through mounting holes 66 in the top surface 30 of the main housing 28. In at least one embodiment the fasteners, are threaded fasteners, such as a screw. One skilled in the art will readily recognize that the use of other types of fasteners is possible without departing from the teachings of the present invention. Still further, in at least the illustrated embodiment, at least some of the fasteners are inserted at an angle 70 which deviates from an angle that is substantially perpendicular 68. By angling some of the fasteners, so as to have a horizontal component, the holding force, maintaining the coupling of the latch mechanism 20 to the window sash 14 can be enhanced in a horizontal direction. At least one of the advantages of angling the fasteners away from an angle that is substantially perpendicular 68, includes enabling the holding force of the fastener 64 to better withstand a horizontally applied force 72, such as the force that might be applied by a collision with wind-swept flying debris. In at least one embodiment, the fasteners 64 are angled relative to the window sash 14 so as to enter the top surface of the top rail 22 in a direction away from the front facing 74 of the window assembly, such that the top 78 of the one or more fasteners 64 are angled toward the front facing 74 of the window assembly.

The latch mechanism, further includes at least a portion of at least one of the sidewall sections 32 and 36, which is substantially parallel to the direction of travel of the bolt 42, that is adapted to extend down from the top 76 of the top rail 22 of the window sash along at least a portion of the external surface of a corresponding one of the front facing 74 and the back facing 80 of the top rail 22. In the embodiment illustrated in FIG. 4, at least a portion of sidewall 32 extends down from the top 76 of the top rail 22 of the window sash 14 along at least a portion 82 of the external surface of the back facing 80, and at least a portion of sidewall 36 extends down from the top 76 of the top rail 22 of the window sash 14 along at least a portion 84 of the external surface or the front facing 74.

The portion of the at least one of the sidewall section, which extends down from the top 76 of the top rail 22 of the window sash 14 provides additional lateral support, in maintaining a connection between the tilt latch mechanism 20 and the window sash 14. Additionally, the extended sidewall section helps to maintain the integrity of the overall structure. This allows greater forces in the form of positive and negative wind pressure 86 to be applied to the window sash without disengaging the tilt latch mechanism 20 from the window sash 14.

Figure 4:
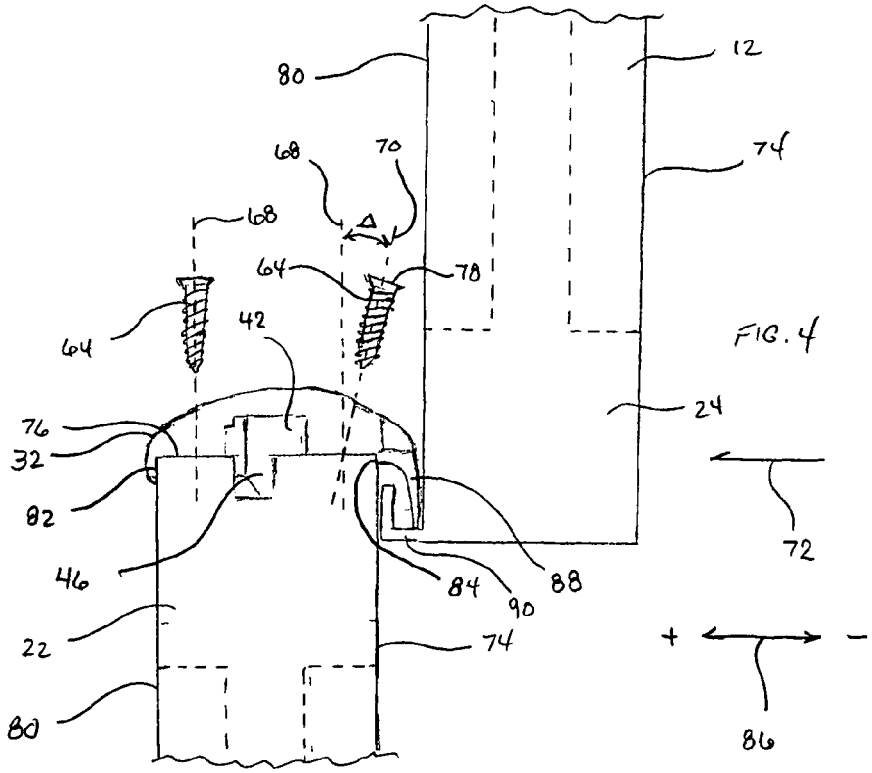
FIG. 4 is a partial side view of a window assembly including a tilt latch mechanism coupled to the top rail of the bottom sash, and engaging the bottom rail of the top sash.
Figure 5:
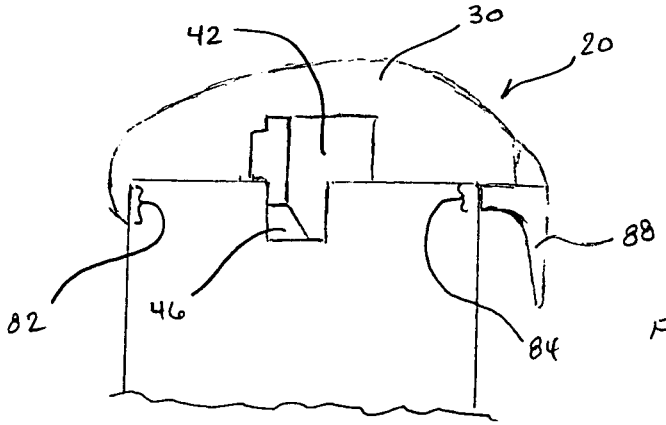
FIG. 5 is an enlarged partial side view of the tilt latch mechanism coupled to the top rail of the bottom sash, illustrated in FIG. 4.

In the embodiment illustrated in FIG. 4, the sidewall 36 further includes an interlock element 88, which extends down further from the top 76 of the top rail a distance away from the external surface of the front facing 74. The interlock element 88 engages a sash interlock 90, which is coupled to and/or integrated with the bottom rail 24 of the top sash 12. By incorporating the interlock element 88 in the tilt latch mechanism 20 greater flexibility in the shape and the selection of materials in the formation of the interlock element 88 is possible. Generally, the tilt latch mechanism is made from a stronger or more durable material than the material used in forming the corresponding rail of the window assembly. The sash interlock 90, when formed as part of the rail, is often made of extruded nylon. Alternatively, an interlock element 88, when formed as part of the tilt latch mechanism can be formed from a molded plastic or a metal casting. This allows the sash interlock 90 to be used to provide further structural support, whereas previously the sash interlock was largely used to provide an air seal, which served to further limit air flow between the two sashes. Furthermore, the amount of support is not only enhanced, but the support is more directly integrated with the tilt latch mechanism.

Figure 13:
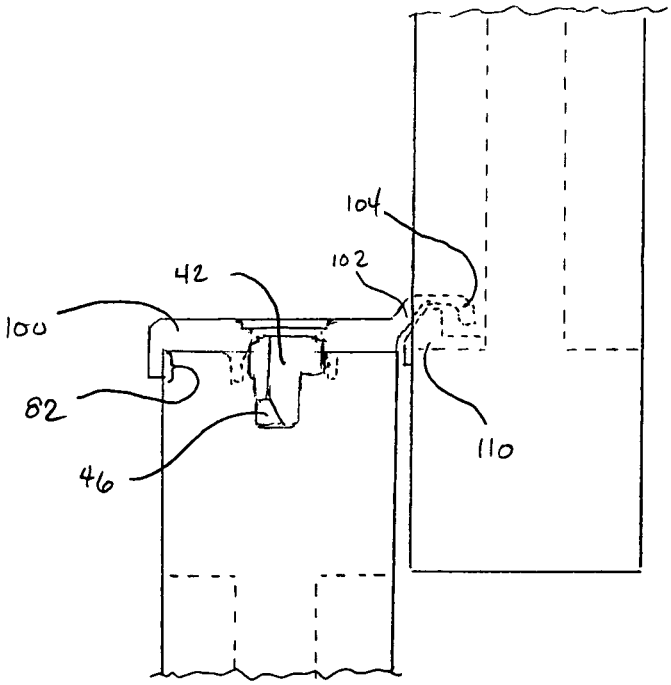
FIG. 13 is a partial side view of a window assembly including the tilt latch mechanism, illustrated in FIG. 10, coupled to the top rail of the bottom sash, and the sash interlock, illustrated in FIGS. 11 and 12, coupled to the bottom rail of the top sash.

The dashed lines in FIGS. 4 and 13, relative to the top and bottom sashes, illustrate the possibility that the external surface of the glass pane can be recessed relative to the top and bottom rails and the side stiles. FIG. 13 further illustrates a window assembly, wherein the top and bottom sash are laterally spaced closer together, and where the top rail of the bottom sash of the bottom rail of the top sash have a greater amount of overlap, when the bottom window sash, within the window assembly, is in a closed position.

Figure 10:
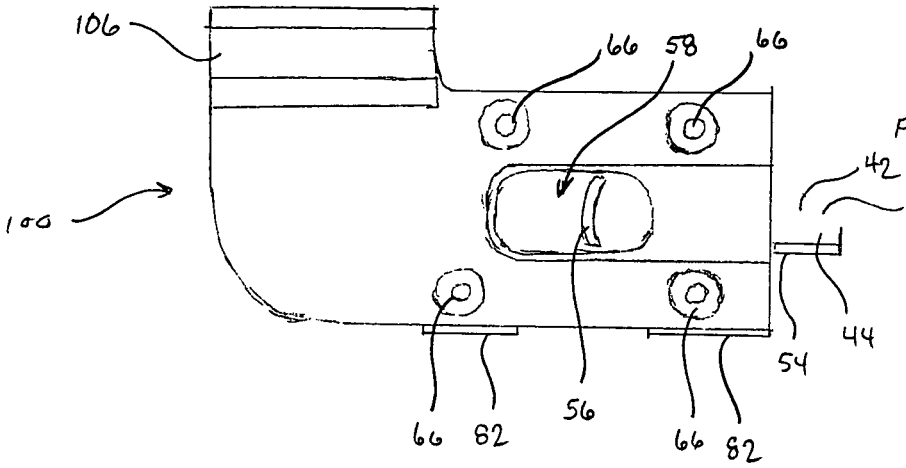
FIG. 10 is a top view of an alternative embodiment of a tilt latch mechanism in accordance with the present invention.
Figure 11:
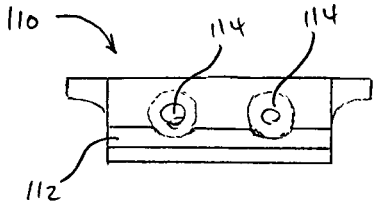
FIG. 11 is a top view of at least one embodiment of a sash interlock for use with the tilt latch mechanism of FIG. 10.
Figure 12:
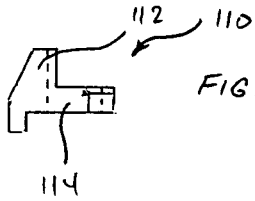
FIG. 12 is a side view of the sash interlock illustrated in FIG. 11.

FIG. 10 illustrates an alternative embodiment of a tilt latch mechanism 100, which is adapted to accommodate at least some of these differences. However, it should be noted that tilt latch mechanism 100, could similarly be beneficially used in other environments, which may not include these specific differences. In the present embodiment, the tilt latch mechanism 100 is adapted to engage a sash interlock 110 (FIGS. 11 and 12), which is coupled to the top of the bottom rail of a top sash within the recessed area. The main housing 102 of the tilt latch mechanism 100 includes a portion 106 (i.e. interlock element), which extends into the recessed region and engages the sash interlock. At least one difference of the present embodiment, relative to the earlier embodiment, the interlock element extends from the at least one sidewall section initially in an upward direction 102 before further extending in a downward direction 104 a distance away from the one of the front facing and the back facing in order to provide a space, therebetween (FIG. 13). The space formed therebetween is adapted to receive a ridge 112, which is included along the surface of the sash interlock 110.

Similar to the tilt latch mechanism 100, the sash interlock 112 can be coupled to the bottom rail of the top sash via one or more fasteners, such as a screw, extending through corresponding mounting holes 114 in the sash interlock 112. Alternatively other forms of fasteners could similarly be used without departing from the teachings of the present invention.

Highlighting on at least one further difference in the alternative embodiment, FIG. 13 further illustrates the possibility that the channel within which the bolt 42 travels does not need to be exclusively located within the main housing, but can extend into and/or at least partially below the top surface of the corresponding rail (i.e. in an at least partially recessed channel cut into the surface of the rail). By at least partially recessing the channel, it may be possible to provide a lower profile tilt-latch mechanism, while still enjoying the beneficial features associated with the teachings of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A latch mechanism adapted for being coupled to a window sash, which travels within a window frame, said latch mechanism comprising:

a main housing adapted for being coupled above a top surface of a top rail of the window sash, the main housing having a sidewall including one or more sidewall sections which extends around at least a portion of the main housing and defines an interior space, the interior space being adapted to reside substantially above the top surface of the top rail at a point having a height consistent with a portion of the top surface of the top rail corresponding to a top edge of one of a front facing and a back facing of the top rail, the interior space includes an opening in said sidewall at one end of said housing, said sidewall forming a channel within the interior space having an end that coincides with said opening, wherein at least a portion of at least one of the sidewall sections which is substantially parallel to the direction of travel of the bolt extends down from a top surface of the main housing of the latch mechanism and is adapted to extend below the top surface of the top rail of the window sash along at least a portion of an external surface of the corresponding one of the front facing and the back facing of the top rail associated with the top edge substantially above which the interior space of the main housing is adapted to reside;

a bolt substantially located within said housing and traveling along said channel, said bolt having a first end which is adapted for extending through the opening of said housing and extending into a side jamb of the window frame; and a tension device coupled to the bolt and the main housing for biasing the bolt toward a position where the bolt extends at least partially through the opening.

2. A latch mechanism in accordance with claim 1 wherein the first end of said bolt has a protrusion, which is adapted to project in the direction of travel of the window sash within the window frame, wherein, as the window sash travels within the window frame, the protrusion at the first end of said bolt is adapted to move between an engaged position and a disengaged position relative to the window frame.

3. A latch mechanism in accordance with claim 2 wherein said protrusion is adapted to project in a downward direction, when the window sash is in an upright position, and is adapted to engage the window frame, when the window sash moves within the window frame toward a closed position.

4. A latch mechanism in accordance with claim 1 wherein at least a portion of a second one of the sidewall sections of the main housing, which is substantially parallel to the direction of travel of the bolt, is adapted to extend down from the top of the top rail of the window sash along the external surface of at least a portion of the other one of the front facing and the back facing of the top rail.

5. A latch mechanism in accordance with claim 1 wherein said top surface of the main housing has a width which is adapted to extend across the width of the top surface of the top rail of the window sash.

6. A latch mechanism in accordance with claim 1 wherein said channel within which the bolt travels is adapted to be located between the top surface of the main housing and the top of the top rail of the window sash.

7. A latch mechanism in accordance with claim 1 wherein the latch mechanism is adapted to be coupled to the top of the window sash via one or more fasteners.

8. A latch mechanism in accordance with claim 7 wherein at least some of the one or more fasteners are adapted to extend through the latch mechanism and into the top surface of the top rail at an angle other than perpendicular relative to the top surface of the top rail.

9. A latch mechanism in accordance with claim 8 wherein the latch mechanism is adapted to be used within a window assembly including one or more window sashes, and wherein the at least some of the fasteners are angled relative to the window sash so as to enter the top surface of the top rail in a direction away from the front facing of the window assembly, such that the top of the one or more fasteners are angled toward the front facing of the window assembly.

10. A latch mechanism in accordance with claim 1 wherein the latch mechanism is adapted to be coupled to a bottom sash within a window assembly having a top sash and the bottom sash, and wherein the at least one of the sidewall sections of the latch mechanism includes an interlock element extending from the at least one sidewall section which is adapted to engage a sash interlock associated with a bottom rail of the top sash.

11. A latch mechanism in accordance with claim 10 wherein the interlock element is adapted to extend down further from the top of the top rail of the window sash along at least a portion of the external surface of one of the front facing and the back facing of the top rail a distance away from the one of the front facing and the back facing to provide for a space, therebetween, within which at least a part of the sash interlock associated with the bottom rail of the top sash will be adapted to occupy, when the interlock element of the latch mechanism is adapted to be engaged with the sash interlock.

12. A latch mechanism in accordance with claim 11 wherein the bottom sash is in or proximate a closed position when the latch mechanism is adapted to be engaged with the sash interlock.

13. A latch mechanism in accordance with claim 10 wherein the interlock element extends from the at least one sidewall section initially in an upward direction before further extending in a downward direction adapted to be a distance away from the one of the front facing and the back facing of the top rail in order to provide a space, therebetween, within which at least a part of the interlock element of the latch mechanism is adapted to be engaged with the sash interlock.

14. A latch mechanism in accordance with claim 13 wherein the sash interlock, to which the latch mechanism is adapted to be engaged, is coupled to a top side of the bottom rail of the top sash.

15. A latch mechanism in accordance with claim 14 wherein the sash interlock, to which the latch mechanism is adapted to be engaged, is coupled to the top side of the bottom rail of the top sash via one or more fasteners.

16. A window assembly comprising:

at least a top sash and a bottom sash, wherein each of the top sash and the bottom sash includes a top rail, a bottom rail, and a pair of stiles;

one or more latch mechanisms coupled to the top rail of at least one of the top sash and the bottom sash, said latch mechanism comprising a main housing coupled above a top surface of a top rail of the window sash, the main housing having a sidewall including one or more sidewall sections which extends around at least a portion of the main housing and defines an interior space, the interior space residing substantially above the top surface of the top rail at a point having a height consistent with a portion of the top surface of the top rail corresponding to a top edge of one of a front facing and a back facing of the top rail, the interior space includes an opening in said sidewall at one end of said housing, said sidewall forming a channel within the interior space having an end that coincides with said opening, wherein at least a portion of at least one of the sidewall sections which is substantially parallel to the direction of travel of the bolt extends down from a top surface of the main housing of the latch mechanism to below the top surface of the top rail of the window sash along at least a portion of an external surface of the corresponding one of the front facing and the back facing of the top rail associated with the top edge above which the interior space of the main housing substantially resides, a bolt substantially located within said housing and traveling along said channel, said bolt having a first end which extends through the opening of said housing and into a side jamb of a window frame, and a tension device coupled to the bolt and the main housing for biasing the bolt toward a position where the bolt extends at least partially through the opening.

17. A window assembly in accordance with claim 16 wherein at least a second one of the sidewall sections of the main housing of at least one of the one or more latch mechanisms, which is substantially parallel to the direction of travel of the bolt, extends down from the top of the top rail of the window sash along the external surface of at least a portion of the other one of the front facing and the back facing of the top rail.

* * * * *